US009835393B2

(12) United States Patent
Lim et al.

(10) Patent No.: US 9,835,393 B2
(45) Date of Patent: Dec. 5, 2017

(54) APPARATUS FOR CIRCULATING BALLS FOR CLEANING A PIPE LINE

(71) Applicant: Jeongwoo Industrial Machine Co., Ltd., Cheonan-si (KR)

(72) Inventors: Jong-Peel Lim, Asan-si (KR); Sang-Phil Chu, Cheonan-si (KR); Geon-Ki Kim, Cheonan-si (KR); Sung-Chul La, Sejong (KR); Jong-Keun Choi, Gangneung-si (KR)

(73) Assignee: Jeongwoo Industrial Machine Co., Ltd., Cheonan-Si (KR)

( * ) Notice: Subject to any disclaimer, the term of this patent is extended or adjusted under 35 U.S.C. 154(b) by 330 days.

(21) Appl. No.: 14/429,353

(22) PCT Filed: Sep. 23, 2013

(86) PCT No.: PCT/KR2013/008495

§ 371 (c)(1),
(2) Date: Mar. 18, 2015

(87) PCT Pub. No.: WO2014/046510

PCT Pub. Date: Mar. 27, 2014

(65) Prior Publication Data

US 2015/0247687 A1 Sep. 3, 2015

(30) Foreign Application Priority Data

Sep. 20, 2012 (KR) ..... 10-2012-0104771
Sep. 20, 2012 (KR) ..... 10-2012-0104772

(51) Int. Cl.
*F28G 1/12* (2006.01)
*F28G 15/00* (2006.01)
(Continued)

(52) U.S. Cl.
CPC ..... *F28G 1/12* (2013.01); *B08B 9/055* (2013.01); *B08B 9/057* (2013.01); *B08B 9/0551* (2013.01);
(Continued)

(58) Field of Classification Search
CPC ..... F28G 1/12; F28G 15/00; F28G 15/003; B08B 9/063; B08B 9/055; B08B 9/0551;
(Continued)

(56) References Cited

U.S. PATENT DOCUMENTS 3,057,758 A * 10/1962 Walker ..... B08B 9/0556 116/DIG. 22
4,420,038 A * 12/1983 Okouchi ..... F28G 1/12 15/3.51
(Continued)

FOREIGN PATENT DOCUMENTS

DE 3827900 * 2/1990
JP 57-14985 * 1/1982
(Continued)

OTHER PUBLICATIONS

International Searching Authority, International Search Report (ISR) for International Application No. PCT/KR2013/008495, dated Dec. 26, 2013, Korean Patent Office.

*Primary Examiner* — Mark Spisich
(74) *Attorney, Agent, or Firm* — Alston & Bird LLP

(57) ABSTRACT

The present invention relates to an apparatus for circulating balls. An embodiment of the present invention includes: a circulation path for circulating balls and fluid, the circulation path comprising a cooling water tube of a heat exchange unit; a pump arranged in the circulation path for pumping the balls and fluid; and a counter for counting the time and the number of the balls in relation to the circulation of the balls.

12 Claims, 7 Drawing Sheets

(51) Int. Cl.

| | |
|---|---|
| ***B08B 9/053*** | (2006.01) |
| ***G06M 7/00*** | (2006.01) |
| ***B08B 9/055*** | (2006.01) |
| ***B08B 9/057*** | (2006.01) |

(52) U.S. Cl.
CPC ..... *B08B 9/0552* (2013.01); *F28G 15/003* (2013.01); *G06M 7/00* (2013.01)

(58) Field of Classification Search
CPC ..... B08B 9/0557; F16L 55/26; F16L 55/46; G06M 7/00; B65G 51/36
USPC ..... 15/3.5, 3.51, 104.061, 104.062; 165/95; 377/6, 7, 11
See application file for complete search history.

(56) References Cited

U.S. PATENT DOCUMENTS

| | | | | | |
|---|---|---|---|---|---|
| 4,556,102 | A * | 12/1985 | Bochinski | F28G 1/12 | 134/8 |
| 4,569,097 | A * | 2/1986 | Echols | B08B 9/055 | 15/104.061 |
| 5,518,068 | A * | 5/1996 | Ricard | F28G 1/12 | 15/3.51 |
| 7,735,545 | B2 * | 6/2010 | Chow | F28G 1/12 | 165/94 |
| 2002/0017379 | A1 * | 2/2002 | Jackson | F28G 1/12 | 165/95 |
| 2002/0148598 | A1 * | 10/2002 | Houel | F28G 1/12 | 165/119 |
| 2011/0100599 | A1 * | 5/2011 | Altegoer | F28F 9/0265 | 165/95 |

FOREIGN PATENT DOCUMENTS

| | | | |
|---|---|---|---|
| JP | 58-24979 | * | 2/1983 |
| JP | 58-66185 | * | 4/1983 |
| JP | 58-208599 | * | 12/1983 |
| JP | 59-33588 | * | 2/1984 |
| JP | 59-200199 | * | 11/1984 |
| JP | 59-215599 | * | 12/1984 |
| JP | 60-243496 | * | 12/1985 |
| JP | 61-202098 | * | 9/1986 |
| JP | 62-134498 | * | 6/1987 |
| JP | 63-263594 | * | 10/1988 |
| JP | 3-102488 | * | 4/1991 |
| KR | 20-0294126 Y1 | | 11/2002 |
| KR | 10-2005-0008214 A | | 1/2005 |
| KR | 10-0537943 B1 | | 12/2005 |
| KR | 10-2006-0028915 A | | 4/2006 |

* cited by examiner (a)

(b)

APPARATUS FOR CIRCULATING BALLS FOR CLEANING A PIPE LINE

TECHNICAL FIELD

This disclosure relates to an apparatus for circulating balls. More specifically, this disclosure relates to an apparatus for circulating balls to clean a pipe line.

BACKGROUND ART

The statements in this section merely provide background information regarding an apparatus for circulating balls and may not constitute the related art.

Rust, foreign substances, and the like are accumulated in a pipe line in which a fluid such as water flows as time passes, and thus when the rust, foreign substances, and the like are left, the inside of the pipe line is gradually narrowed to cause a problem that an apparatus or a system is not normally operated.

In order to solve such a problem, recently, techniques of injecting a large number of cleaning balls into a pipe line to be circulated inside the pipe line so as to remove scale accumulated in the pipe line have been applied.

For example, the pipe line may comprise a plurality of tubes arranged in a heat exchanger of a powder plant. The heat exchanger of the powder plant is configured to have plural tubes and is an apparatus which cools water for power generation using sea water or fresh water, and an equipment for cleaning the tubes is referred to as a cleaning equipment.

For cleaning the tubes, elastic cleaning balls are injected into a water box of a condenser in which cooling water flows. Then the cleaning balls are evenly dispersed in the water box and flow into each tube, so as to clean the inside of the tubes.

The cleaning balls thus passing through the tubes are separated from the cooling water by a strainer at an outlet, pass through a ball recirculation pump (hereinafter, simply referred to as a "pump") and a ball collector again, and then are re-injected into an inlet of the water box through a ball injection nozzle so that continuous tube cleaning is possible.

When an appropriate number of balls are circulated, the condenser tube is kept clean and the thermal conductivity of the tube is maintained in good condition and thus the performance of the condenser or the heat exchanger can be ensured.

Therefore, it is necessary to check whether or not an appropriate number of balls are circulated through the cleaning equipment.

The related art adopts, as a measure of the degree of the cleaning state, a method of checking the collection rate of cleaning balls, that is, how many balls are collected with respect to the number of balls injected into a circulation path. For example, when 1000 cleaning balls are injected into a circulation path, circulated, and then collected, if the number of balls collected is 950, it is determined that better cleaning is carried out compared to a case where 900 balls are collected.

However, in the related art, only the number of balls circulated in the circulation path is considered and thus a problem arise in that whether the balls perform an efficient and effective role of cleaning tubes cannot be actually assessed.

This is because some of the balls are not circulated due to swirl or trapping or loss of the balls caused by the structure of the circulation path and the internal shape of the circulation path, and due to these balls, it is meaningless to consider only the number of circulating balls for evaluating the degree of cleaning.

The related art has a problem in that in the above-described example, if 50 to 100 balls are not normally circulated or lost, it is assumed that 900 to 950 balls are normally circulated and if 900 balls sufficiently perform a role of cleaning the tubes while being circulated in the circulation path, there is no reason for evaluating that cleaning is poor compared to a case where 950 balls are circulated.

On the other hand, the cleaning equipment adopts a counter as means for checking whether or not an appropriate number of balls are circulated through the cleaning equipment. The counter is a device for counting the number of cleaning balls circulating inside the circulation path.

A conventional counter (Korean Patent Publication No. 10-2005-0008214) has a structure in which a transparent passage pipe is arranged in the middle of a circulation path and a sensor is arranged on the outside of the passage pipe and emits infrared rays to detect balls flowing inside the passage pipe and count the number of the balls.

However, in the conventional structure, since balls are aggregated and pass together through the passage pipe, many balls may be counted as one by being detected at the same time and thus there is a problem of erroneous counting of the number of the cleaning balls.

SUMMARY OF INVENTION

Technical Problem

An object of an embodiment of the present invention is to provide a ball circulating apparatus for cleaning a pipe line which adopts a new method for checking the degree of pipe cleaning so as to solve the problems in the related art.

Another object of the embodiment of the present invention is to provide a counter capable of more precisely counting the number of cleaning balls by preventing plural balls from being aggregated and passing together through a passage pipe.

Solution to Problem

According to an embodiment of the present invention, an apparatus for circulating balls may include a circulation path for circulating a fluid and balls. The circulation path may include a cooling water tube of a heat exchanger.

The apparatus may include a pump arranged on the circulation path for pumping the fluid.

Further, the apparatus may include a counter for counting time and the balls in relation to the circulation of the balls.

As one embodiment, the counter may count the number of balls passing therethrough for a predetermined period of time. The predetermined period of time may be a period of time for one circulation of the balls (hereinafter referred to as a "ball circulation period") during which the balls make one circulation through the circulation path.

The counter may calculate a rate (hereinafter referred to as a "ball period circulation rate") which is obtained by dividing the number of balls counted during the ball circulation period by the number of balls input into the circulation path.

As an exemplary embodiment, the counter may count the time during which a predetermined number of balls make a predetermined number of circulations through the circulation path.

The counter may count the balls up to the number which is the same as the number of the balls input into the circulation path and count time which is taken for the counted number of balls to make a predetermined number of circulations.

The predetermined number of balls may be the number of balls which is actually circulated in the circulation path.

The predetermined number of balls may be smaller than the number of balls input into the circulation path.

The counter may be configured to count time which is taken for a predetermined number of balls to pass through the counter.

The counter may count time which is taken for the number of balls input into the circulation path to pass through the counter.

The predetermined number may be the number of balls which is actually circulated in the circulation path.

The predetermined number may be smaller than the number of balls input into the circulation path.

The ball may be made of an elastic material.

The diameter of the ball may be larger than the inner diameter of the cooling water tube.

The counter may include a first passage pipe in which the balls and the fluid flow.

Further, the counter may include a second passage pipe arranged in the first passage pipe.

Further, the apparatus for circulating balls may include a screen arranged in the first passage pipe and having an inclined surface for guiding the balls flowing in the first passage pipe to the second passage pipe.

Further, the apparatus may include a sensor for counting the number of balls flowing in the second passage pipe.

The first passage pipe and the second passage pipe may have cylindrical shapes, respectively.

The first passage pipe may be configured to allow the fluid and the balls to flow in the same direction.

The second passage pipe may be configured to allow the fluid and the balls to flow in the same direction.

The first passage pipe may have connection portions on both sides. Through the connection portions, the pipe can be connected with the circulation path.

The diameter of the second passage pipe may be larger than the diameters of the balls.

The screen may comprise a plurality of holes having such sizes that the balls are unable to pass therethrough.

The total cross-sectional area of the flow path formed by the plurality of holes may be larger than the cross-sectional area of the flow path formed by the second passage pipe.

The screen may have a funnel shape.

The sensor may have a light emitting portion. Further, the sensor may have a light receiving portion.

At least a part of the first passage pipe may be transparent so that the light from the light emitting portion can be emitted to the light receiving portion. Further, the second passage pipe may be transparent at a portion corresponding to the transparent portion of the first passage pipe.

Effects of Invention

As described above, an embodiment of the present invention provides a new method for more effectively determining a degree of pipe cleaning by considering time and the number of balls when cleaning a pile line using cleaning balls.

An embodiment of the present invention is advantageous in that the number of cleaning balls circulating in the circulation path can be exactly counted.

Further, it is advantageous that a ball counter may be formed in a simpler structure and thus the durability of the counter can be improved and the manufacturing cost can be lowered.

DESCRIPTION OF EMBODIMENTS

An apparatus for circulating balls according to an embodiment of the present invention will be described in detail with reference to the accompanying drawings. The present invention may be embodied in various forms and thus only a few embodiments will be described in detail in the specification with the drawings. However, it should be understood that the description of the embodiments is not intended to limit the present invention. In the description of the drawings, the same reference numbers are used the same components or parts. In the accompanying drawings, some parts are illustrated in an enlarged scale or a smaller scale to show in detail or schematically.

In addition, the terms of "first" and "second" may be used for description of various elements. However, these elements are not limited to these terms. The terms are used only for the purpose of distinguishing one element from the other. For example, within the range not departing from the scope of the present invention, a first element may be referred to as a second element and the second element may be referred to as the first element in the same manner.

Figure 1:
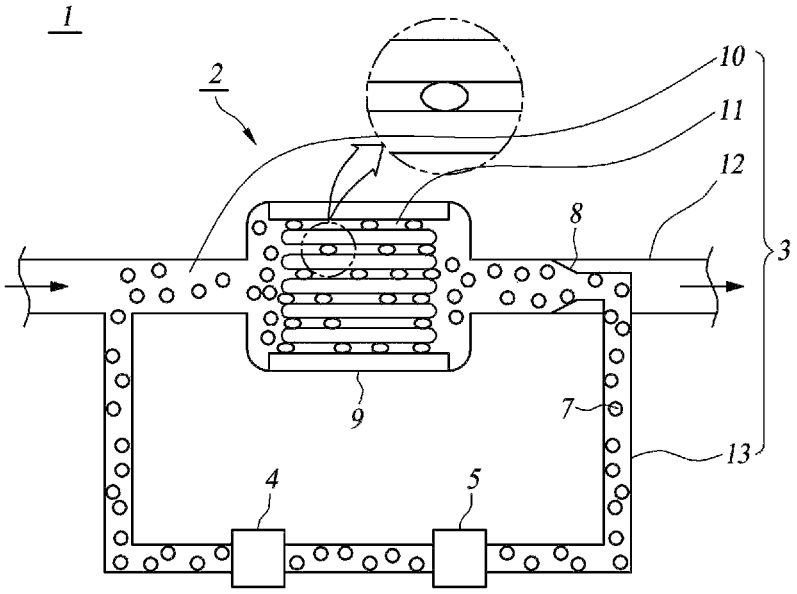
FIG. 1 illustrates an apparatus for circulating balls according to an embodiment of the present invention.

FIG. 1 is a view schematically illustrating the configuration of an apparatus for circulating balls (1) according to an embodiment of the present invention and a partially enlarged view thereof. In the drawing, the apparatus is combined with a heat exchanger (2) of a power plant to be used as a cleaning apparatus for the heat exchanger.

The apparatus for circulating balls (1) according to the embodiment of the present invention may include a circulation path (3), a pump (4), a counter (5), and a strainer (8). The circulation path (3) includes a cooling water tube (11) of the heat exchanger (2) and a fluid and balls (7) are circulated therein. The strainer (8) may be arranged on the circulation path (3). The pump (4) may be arranged on the circulation path (3) and pumps the fluid to be circulated. The counter (5) is arranged on the circulation path (3) and counts the number of balls (7) circulating in the circulation path (3).

The ball (7) may be formed with an elastic material. For example, the ball is made of silicone, sponge or rubber.

The circulation path (3) may include an inlet pipe (10), an outlet pipe (12), the cooling water tube (11), and a circulation pipe (13). The strainer (8) is arranged on the outlet pipe (12) and plays a role of separating the balls (7) and the fluid in the outlet pipe (12) and moving the balls and fluid to the circulation pipe (13).

The heat exchanger (2) may include a main body (9) and the cooling water tube (11). The inlet pipe (10) is connected to the main body (9) on the upstream side and the outlet pipe (12) is connected to the main body on the downstream side. Inside the main body (9) of the heat exchanger (2), plural cooling water tubes (11) to be connected with the inlet pipe (10) and the outlet pipe (12) may be arranged.

For example, cooling water may be sea water or fresh water. The cooling water is introduced into the main body (9) through the inlet pipe (10), then passes through the plural cooling water tubes (11) in the main body (9), and is discharged to the outside through the outlet pipe (12).

The fluid may be circulating water which is not introduced or discharged to the heat exchanger (2) as a part of the cooling water and continuously circulated through the circulation path (3).

The fluid as a part of the cooling water flows out from the outlet pipe (12) through the strainer (8) connected to the middle of the outlet pipe (12), passes through the circulation pipe (13), and then is introduced into the cooling water tube (11) through the inlet pipe (10). That is, the fluid circulates along the circulation path (3). The fluid may circulate in the circulation path (3) with the balls (7).

The counter (5) counts time and the number of balls (7) circulating in the circulation path (3) to show whether or not the inside of the cooling water tube (11) is sufficiently cleaned. The method of determining the degree of cleaning using the counter (5) and the structure of the counter (5) will be described later.

The method of cleaning the cooling water tube (11) will be described. A large number of balls (7) are injected into the circulation path (3) through an injection portion (not shown). The fluid is circulated in the circulation path (3) by the pump (4) and the large number of balls (7) are circulated with the fluid. The balls (7) and the fluid flow along the circulation pipe (13) and flow into the inlet pipe (10). The cooling water introduced from the outside, the balls (7) and the fluid introduced through the circulation path (3) are joined in the inlet pipe (10). The cooling water, the balls (7) and the fluid joined in the inlet pipe (10) are introduced into the main body (9) of the heat exchanger. In the main body (9) of the heat exchanger, a large number of cooling water tubes (11) are arranged. The diameter of the ball passing through the cooling water tube (11) is larger than the inner diameter of the cooling water tube (11). Depending on embodiments, the diameter of the ball (7) may be larger than the inner diameter of the cooling water tube (11) by 1 mm to 2 mm. The ball (7) may be formed with an elastic material. Thus, the ball (7) becomes elastic as passing though the tube (11). That is, when the ball (7) passes through the tube (11), the ball is tightly fitted to the inner surface of the tube (11) and scrapes out scale accumulated inside the tube in a state of being in tight contact with the inner surface of the tube (11) (refer to the partially enlarged view of FIG. 1). Such a structure has an effect of easily removing scale that is accumulated and solidified inside the tube (11).

The balls (7) passing through the tube (11) moves to the outlet pipe (12) again with the cooling water and fluid. The cooling water is discharged to the outside by the outlet pipe (12) and the fluid and the balls (7) are moved to the circulation pipe (13) through the strainer (8) arranged in the middle of the outlet pipe (12) to be recirculated in the circulation path (3).

The method of determining the degree of tube cleaning using the counter (5) will be described.

The apparatus for circulating balls (1) according to the embodiment of the present invention provides a new method for determining whether or not the cooling water tube (11) is sufficiently cleansed.

First, the related art for determining the degree of cleaning of the tube (11) will be described. In the related art, a method of determining the degree of cleaning based on the collection rate of the cleaning balls (7), that is, the number of balls collected with respect to the number f balls injected into the circulation path (3) is adopted. For example, if 1000 cleaning balls (7) are injected into the circulation path (3), circulated, and then only 950 balls are collected, it is evaluated that better cleaning is carried out compared to a case where 900 balls are collected. In this manner, the degree of cleaning is assessed.

That is, in the related art, the degree of cleaning is determined based on the number of collected balls (7).

A conventional method of the related art is based on a factual result that the number of collected balls becomes smaller than the number of the balls (7) input into the circulation path (3) due to the causes such as swirl or trapping or loss of the balls caused by the structure and the inner shape of the circulation path (3). The conventional method is based on a premise that better pipe cleaning is carried out in a case where a large number of balls (7) are circulated in the circulation path (3) than a case where a small number of balls (7) are circulated.

However, the amount of balls not circulated and lost due to the cases is generally constant. Thus, counting the number of balls (7) excluding the lost ones is not a good method for evaluating the degree of cleaning.

That is, in the above example, when about 50 to 100 balls (7) are not normally circulated or lost, and so 900 to 950 balls (7) are circulated, if 900 circulating balls sufficiently perform a function for cleaning the tube (11), then there is no reason for evaluating that the cleaning with the 900 balls is poor compared to a case where 950 balls are circulated. In this regard, the conventional method is problematic.

The conventional method is meaningful only in a case where the number of balls (7) collected is remarkably decreased compared to the number of balls (7) input.

Particularly, as the difference between the number of balls injected and the number of balls collected is small, it is not appropriate to use a comparison only with the numbers of balls (7) or a collection rate for precisely evaluating the degree of cleaning. Thus, the related art does not provide an appropriate method for evaluating the cleaning performance.

The apparatus for circulating balls (1) according to the embodiment of the present invention provides a measure using not only the number of balls but also the concept of time for evaluating the degree of cleaning.

The counter (5) of the apparatus for circulating balls (1) according to the embodiment of the present invention can count time and the number of balls (7) for determining the degree of cleaning in relation to the circulation of the balls (7). The counter (5) does not count only the number of balls (7). The counter (5) includes a control part (not shown). The counter (5) can count the time for the number of balls passing therethrough by the control part.

The counter (5) can count the number of balls passing the counter (5) for a predetermined period of time. For example, the counter (5) can count the number of balls (7) passing through the counter for one hour. In this case, as the counted result value (number of balls) is higher, it can be evaluated that the degree of cleaning is high.

The related art has a problem in that it is inconvenient to count the number of balls (7) since the circulating balls needs to be collected for the counting.

However, according to the embodiment of the present invention, the number of balls (7) circulating in the circulation path (3) can be directly counted by the counter (5) and thus it is easy to evaluate the degree of cleaning.

The predetermined period of time may be a ball circulation period. The ball circulation period may be defined as the period of time which is taken for the balls to make one circulation in the circulation path (3).

For example, the ball circulation period can be obtained by a method of measuring the time for one ball (7) in the circulation path (3) to take for making one circulation. In a case of injecting a large number of balls (7) into the circulation path (3), the time can be measured by changing the color of some (7) of the injected balls (7) or attaching a sensor to some of the balls. When the large number of balls (7) are circulated in the circulation path, the time for aligning the balls (7) in the ball collector (not shown), that is, the time for the balls (7) staying in the ball collector is added the time for one ball (7) making one circulation in the circulation path to obtain the circulation period for the total balls (7). Further, when the velocity of the fluid is the same as the circulation speed of the ball (7), ball circulation period can be measured in such a manner that the velocity of the fluid circulating in the circulation path (3) is measured and then the length of the circulation path (3) is divided by the velocity of the fluid.

The degree of tube cleaning can be evaluated by calculating a ball period circulating rate. The ball period circulation rate is a value obtained by dividing the number of balls (7) counted during the ball circulation period by the number of balls (7) injected into the circulation path (3). The number of balls (7) passing through the counter (5) is counted during the ball circulation period and the number is divided by the number of balls (7) injected into the circulation path (3) to calculate the ball period circulation rate. As the ball period circulation rate is high, the degree of cleaning is high.

According to another embodiment of the present invention, the counter (5) may count the time for a predetermined number of balls (7) making a predetermined number of circulations in the circulation path (3).

Here, the predetermined number of circulations is a preset number. For example, the counter (5) may be configured to count the time for all the circulating balls (7) making n number of circulations in the circulation path (3) (n is a positive integer).

Here, the predetermined number of balls may be the number of balls (7) input into the circulation path (3). Here, the number of the input balls (7) may be the number of balls (7) injected into the circulation path (3). That is, the counter can count the time which is taken for the total number of input balls (7) to make the predetermined number of circulations. For example, when 1000 balls (7) are input, the time for the ball counted as $1000^{th}$ making one circulation can be counted.

That is, in the above example, as a result of injecting 1000 balls (7) and circulating, in a first case in which 950 balls (7) are circulated, the counter (5) counts the number from a first ball (7) and counts a $950^{th}$ ball (7) as 950, and then, counts as a $951^{th}$ ball the first ball (7) which returns to the counter (5) after having made one circulation in the circulation path (3). In this manner, a $50^{th}$ returned ball (7) is counted as a $1000^{th}$ ball. In a second case in which 1000 balls (7) are injected and only 900 balls are circulated, the counter (5) counts the number from a first ball (7) and counts a $900^{th}$ ball as 900 and then counts the first ball (7) which returned to the counter (5) as a $901^{th}$ ball. In this manner, a $100^{th}$ returned ball (7) is counted as a $1000^{th}$ ball.

In both cases, even when 1000 balls, which is the number of input balls, are counted, the number of balls actually not circulated (50 in the first case and 100 in the second case) is counted and thus there is a difference between one circulation periods of the two cases. Therefore, in a case where a predetermined number is the number of balls (7) injected into the circulation path (3), it is meaningful.

Comparing the both cases, the counting time in the second is longer than the time in the first case. That is, the time for the balls (7) making one circulation in circulation path (3) is shorter in the first case than in the second case. Therefore, it can be evaluated that the first is better.

In addition, the predetermined number may be the number of balls (7) actually circulating in the circulation path (3). When there are balls not circulating in the circulation path due to swirl or trapping or loss of the balls caused by the structure of the circulation path and the internal shape of the circulation path, the time for the number of balls (7) actually circulating in the circulation path making a set number of circulations can be counted.

Further, the predetermined number may be smaller than the number of balls (7) injected into the circulation path (3). For example, the time for 100 balls making one circulation in the circulation path can be counted.

According to another embodiment of the present invention, the counter (5) may count the time for a predetermined number of balls (7) passing through the counter. For example, the counter can count the time for (5) a preset 1000 balls passing through the counter. In this case, as the counted result value (time) is small, the degree of cleaning is evaluated as high.

The structure of the counter (5) will be described.

Figure 2:
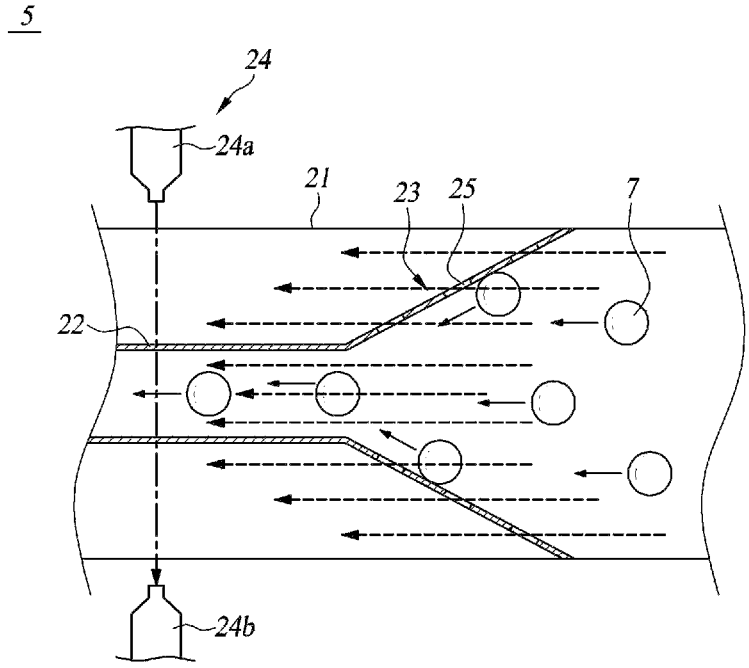
FIG. 2 is a conceptual view illustrating a ball counter according to an embodiment (first embodiment) of the present invention.

FIG. 2 is a conceptual view illustrating the ball counter (5) according to an embodiment (first embodiment) of the present invention. A drawing of the control portion is omitted. As shown in the drawing, the counter (5) may include a first passage pipe (21) into which the large number of balls (7) and a fluid flow, a second passage pipe (22) arranged in the first passage pipe (21), a screen (23) arranged in the first passage pipe (21), and a sensor (24) for counting the number of balls (7) flowing in the second passage pipe (22). The arrow indicated by a dotted line in FIG. 2 represents a flowing direction of the fluid and the arrow indicated by a solid line in FIG. 2 represents a flowing direction of the ball (7).

The first passage pipe (21) may have a hollow cylindrical shape. In addition, the first passage pipe may be transparent so that the light emitted from the sensor (24), which will be described later, can pass through. The both ends of the first passage pipe (21) can be provided with connection portions so that the counter can be connected with the circulation path (3) in which the fluid flows.

The second passage pipe (22) may have a hollow cylindrical shape. In addition, a portion of the second passage pipe located correspondingly to the transparent portion of the first passage pipe (21) may be transparent so that the light emitted from the sensor (24), which will be described later, can pass through. The diameter of the second passage pipe (22) is larger than the diameter of the ball (7). Thus, the ball (7) can smoothly pass through the second passage pipe with the fluid. That is, the ball (7) can move with the fluid without a decrease in velocity when passing through the second passage pipe (22). The diameter of the second passage pipe (22) has a size in which two balls (7) are unable to pass at the same time. The length of the second passage pipe (22) may be longer than the length of the first passage pipe (21).

In the screen (23), a plurality of holes (25) may be formed. Here, the size of the hole is sufficiently small such that the ball (7) is unable to pass. The total cross-sectional area of the flow path of the plurality of holes (25) may be larger than the flow path cross-sectional area of the second passage pipe (22). Therefore, the amount of fluid flowing in the first passage pipe (21) is larger in the screen (23) than in the second passage pipe (22). As a result, the flowing of the fluid in the first passage pipe (21) is smooth. The holes (25) may be formed in various shapes such as a rectangular shape or a cylindrical shape. Any shaped holes can be used as the holes (25) in this embodiment, only if the holes are configured to allow for the fluid to pass through but not for the balls.

One side of the screen (23) is connected to the first passage pipe (21) and the other side thereof is connected to the second passage pipe (22). Depending on embodiments, the screen (23) may be integrally formed with the second passage pipe (22). Further, the first passage pipe (21) may be integrally formed with the screen (23). The diameter of the portion of the screen connected to the first passage pipe (21) is larger than the diameter of the portion of the screen connected to the second passage pipe (22). The screen (23) may have a funnel shape. The screen (23) has an inclined surface. That is, the screen has a surface inclined in the length direction of the first passage pipe (21) or the second passage pipe (22). However, the contour from the portion connected to the first passage pipe (21) to the portion connected to the second passage pipe (22) may not be necessarily linear. The inclined surface perform a role of guiding the balls (7) flowing in the first passage pipe (21) to the center of the second passage pipe (22). That is, the fluid flows through the spaces (25) formed on the inclined surface and the balls and the fluid flow through the second passage pipe (22) connected to the center of the screen (23).

After the balls (7) pass through the second passage pipe (22), the balls keep circulating along the circulation path (3).

The sensor (24) includes a light emitting portion (24*a*) and a light receiving portion (24*b*). In addition, the sensor may be arranged in the first passage pipe (21) or on the outside of the first passage pipe. When the sensor is arranged in the first passage pipe (21), it is preferable to have waterproofing means. The light emitting portion (24*a*) and the light receiving portion (24*b*) are arranged on the sides of the second passage pipe (22) so as to face each other with the second passage pipe (22) interposed therebetween.

The light emitting portion (24*a*) can emit light. The light receiving portion (24*b*) can detect the light emitted from the light emitting portion (24*a*). As for the light, infrared rays may be used depending on embodiments. The light emitted from the light emitting portion (24*a*) may pass through the transparent portion of the first passage pipe (21) or the second passage pipe (22) to be incident into the light receiving portion (24*b*).

Depending on embodiments, in a case where the ball (7) is made of a material that light cannot pass through, the light receiving portion (24*b*) can detect light only when the balls (7) do not pass though the second passage pipe (22). When the light receiving portion (24*b*) detects light, a detection signal is sent to the control portion. The control portion counts the number of balls (7) passing though the second passage pipe (22) by the detection signal transmitted by the sensor (24). The control portion that counts the number of balls (7) and the wiring connecting the control portion and the sensor (24) are known techniques and the description will be omitted.

Figure 3:
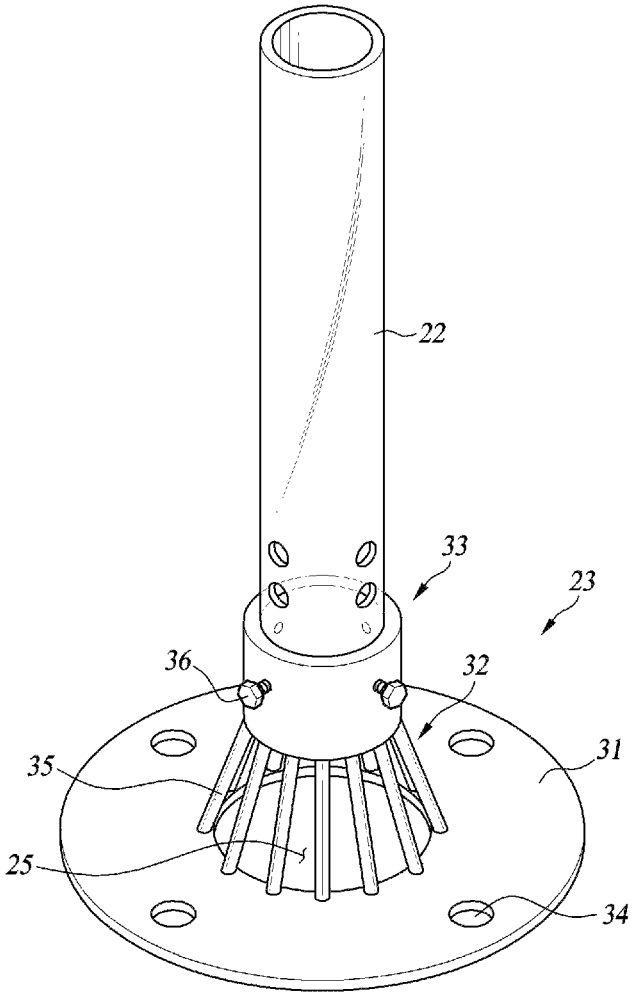
FIG. 3 is a perspective view illustrating a counter according to another embodiment (second embodiment) of the present invention in which a second passage pipe and a screen is combined.

FIG. 3 is a perspective view illustrating the counter (5) according to another embodiment (second embodiment) of the present invention in which the second passage pipe (22) and the screen (23) is combined. The sensor (24) is not shown. In FIG. 3, the material of the second passage pipe (22) is transparent. As shown in the drawing, the screen (23) includes a flange portion (31), a strainer portion (32), and a second passage pipe connecting portion (33). The first flange portion (31) comprises a plurality of bolt holes (34) to connect the first flange portion (31) to the first passage pipe (21) and the circulation path (3). The strainer portion (32) comprises a plurality of spokes or bars (35) extended from the second passage pipe connecting portion (33) to the first flange portion (31). The holes (25) are formed between the bars (35). The second passage pipe connecting portion (33) has a cylindrical shape and has a plurality of bolts (36) screwed on the circumferential surface so as to be combined with the second passage pipe (22). Depending on embodiments, the second passage pipe (22) may be integrally formed with the screen (23). In addition, depending on embodiments, the second passage pipe (22) and the screen (23) may be integrally formed with the first passage pipe (21).

Figure 4:
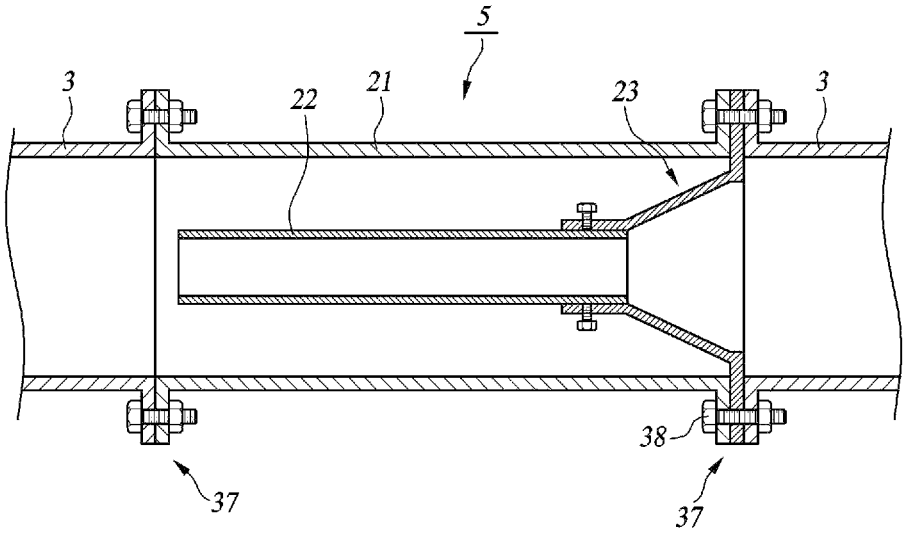
FIG. 4 is a cross-sectional view illustrating a state in which the counter according to the second embodiment of the present invention is connected with a circulation path.

FIG. 4 is a cross-sectional view illustrating a state in which the counter (5) according to the second embodiment of the present invention is connected with the circulation path (3). The sensor (24) is not shown in the drawing. As shown in the drawing, the combined body of the second passage pipe (22) and the screen (23) is connected to the first passage pipe (21) and the both ends of the first passage pipe (21) are connected to the circulation path (3). The both ends of the circulation path (3) are bent in L shape and the both ends of the first passage pipe (21) are also bent in L shape. When FIG. 4 is viewed, the first passage pipe (21), the flange portion (31) of the screen (23), and the pipe are sequentially connected in the connection portion (37) on the right side and screwed by bolts (38). However, in another embodiment, instead of being the both ends of the first passage pipe (21) in L shape, a pair of connection portions for connection with the circulation path (3) may be separately attached.

Figure 5:
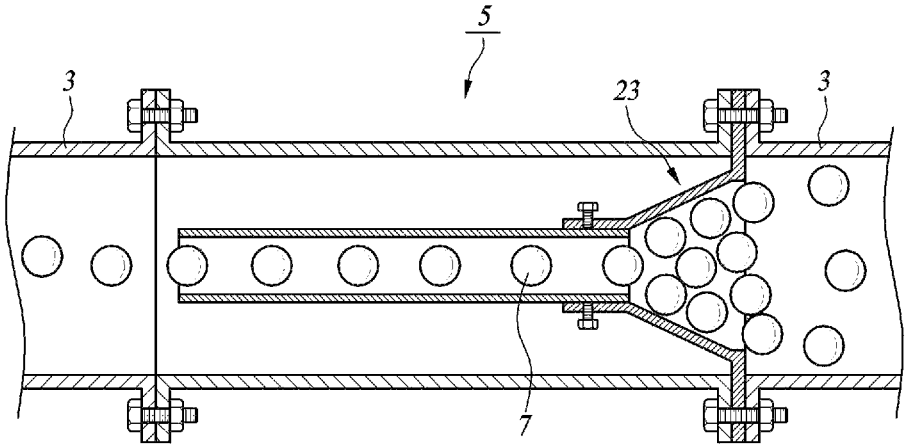
FIG. 5 is a cross-sectional view illustrating a state in which balls flow into the second passage pipe of the counter according to the second embodiment of the present invention connected with the circulation path.

FIG. 5 is a cross-sectional view illustrating a state in which the balls (7) flow into the second passage pipe (22) of the counter (5) according to the second embodiment of the present invention connected with the circulation path (3). The sensor (24) is not shown in the drawing. The plural rows of balls (7) flowing disorderedly are guided to the center through the inclined surface of the screen (23) and pass through the second passage pipe (22).

Figure 6:
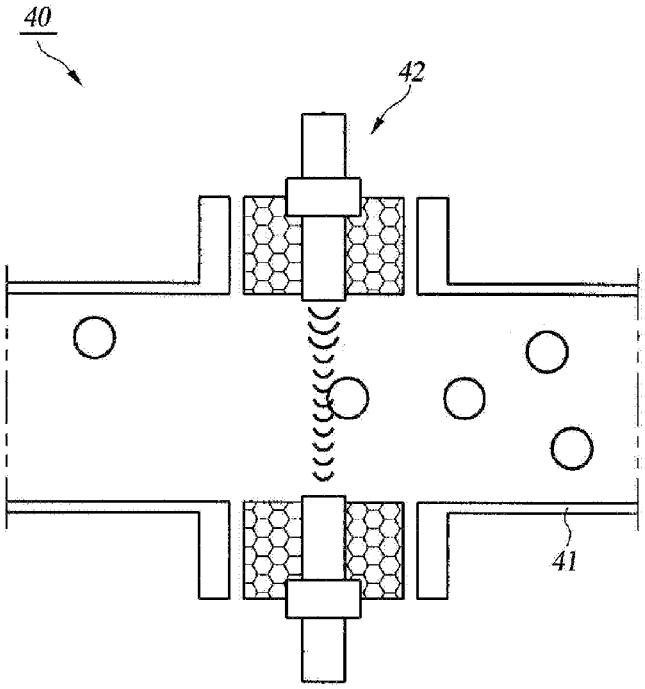
Prior Art FIG. 6
FIG. 6 is a schematic view illustrating the configuration of a conventional counter.

FIG. 6 is a schematic view illustrating the configuration of a conventional counter (40). As shown in the drawing, the conventional counter (40) includes a housing (41), detecting means (42), and cleaning balls (7). The operation principle is that the detecting means (42) positioned on the outside of the housing (41) emits infrared rays to the large number of cleaning balls (7) passing through the housing (41) to count the number of cleaning balls (7).

In the conventional counter (40) (refer to FIG. 6), since the plural balls can be aggregated and pass through the housing (41), the detecting means (42) may detect a plurality of balls (7) at the same time and thus erroneous counting of the number of balls (7) occurs. However, the counter (5) according to the embodiment of the present invention has effect of exactly counting the number of balls since the balls (7) pass through the second passage pipe (22) one by one.

Figure 7:
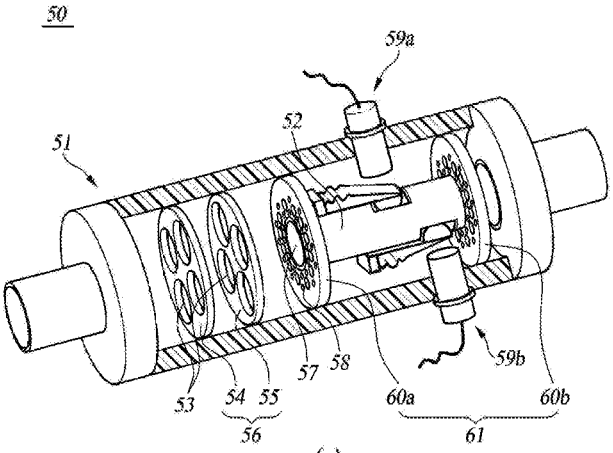
Prior Art Fig. 7
FIGS. 7(*a*)-7(*b*) are schematic views illustrating the configuration of an improved conventional counter.
Figure 7:
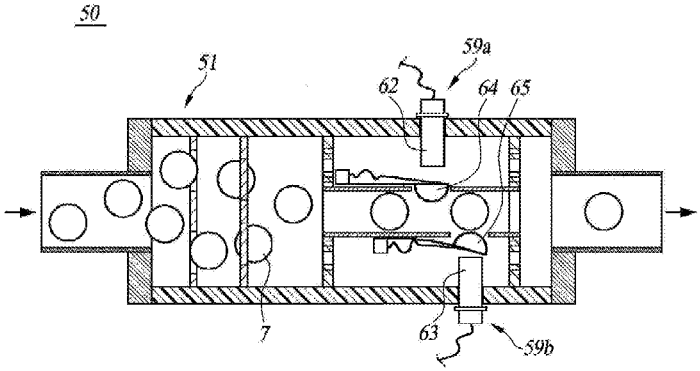
Prior Art Fig. 7

FIG. 7 is a schematic view illustrating the configuration of an improved conventional counter (50, Korean Patent Publication No. 10-2006-0028915). FIG. 7(*a*) is a perspective view and FIG. 7(*b*) is a cross-sectional view showing an operation example. As shown in the drawing, the improved conventional counter (50) includes a housing (51), arrangement means (56) for arranging plural cleaning balls (7) flowing into the housing (51), rate control means (61) composed of flow rate control plates (60*a*, 60*b*) in which a hole (57) through which the cleaning balls (7) can pass one by one and a large number of bypass holes (58) are formed, and detecting means (59*a*, 59*b*) for detecting the large number of cleaning balls (7) passing arranged by the arrangement means.

The arrangement means (56) is composed of plural arrangement plates (54, 55) which are separated from each other in the housing (51) and have plural holes (53) through which the cleaning balls (7) can pass, and the holes (53) formed in the two adjacent arrangement plates (54,55) are alternately arranged.

The detecting means (59*a*, 59*b*) includes a counter tube (52) formed such that the large number of cleaning balls (7) passing through the arrangement means (56) pass through the tube, first and second cut portions formed in the counter tube (52) in the travelling direction of the cleaning ball (7) with a predetermined positional difference, first and second detection plates (64, 65) in which one end is fixed to the outer surface of the counter tube (52) and the other end is positioned in the first or second cut portion and in contact with the cleaning balls (7) passing through the counter tube (52) to be elastically deformed, and first and second sensor (62, 63) for generating a signal to detect the deformation of the first and second detection plates (64,65).

In the improved conventional counter (50) (refer to FIG. 7), the diameter of the counter tube (52) is small and thus a foregoing ball (7) is pushed by the following ball (7). Thus, the balls (7) are in tight contact with one another and pass through the counter tube (52) and thus there is a disadvantage that the balls (7) have to be counted only by a contact sensor. However, the diameter of the second passage pipe (22) is sufficiently larger than the diameter of the ball (7) in the counter (5) according to the embodiment of the present invention, and thus there is an advantage that a non-contact sensor can be used.

In the counter (5) according to the embodiment of the present invention, the balls (7) are guided to the center of the screen (23) along the inclined surface and pass thought the second passage pipe (22) one by one. The balls (7) are not pushed by water pressure to pass through the second passage pipe (22). One ball (7) enters the second passage pipe (22) and then another ball (7) enters the second passage pipe (22). The balls are moved by the flowing of the fluid and the following ball (7) does not push the foregoing ball (7). Thus, there is a low possibility of the balls (7) being aggregated while passing the passage pipe. Therefore, as in the improved conventional counter (50) (refer to FIG. 7), there is no need to arrange separate arrangement means (56) and plural detecting means (59*a*, 59*b*), which will be described later. As a result, the structure of the product is simple and thus the durability of the product is good and the manufacturing cost can be reduced.

Further, in the improved conventional counter (50) (refer to FIG. 7), the rate control means (61) and the arrangement means (56) are connected to each other in a direction perpendicular to the length direction of the counter tube (52) and the flowing direction of the fluid and thus the flowing of the fluid and the balls (7) is poor. However, in the counter (5) according to the embodiment of the present invention, the screen (23) having the inclined surface in which a large number of spaces (25) are formed is formed or arranged and thus the flowing of the fluid and the balls (7) is smooth.

The first and second detection plates (64, 65) in the improved conventional counter (50) (refer to FIG. 7) transmits the detection signal to the first and second sensors (62, 63) by being elastically deformed while being in direct contact with the balls (7) passing through the counter tube (52). Accordingly, since the detection plates (64, 65) are in direct contact with the large number of balls (7), there is a problem of the detecting means (59*a*, 59*b*) being easily broken and the material of the ball (7) is typically a material that is easily worn out such as silicone or sponge and thus there is a problem of the ball (7) being easily worn out. However, in the counter (5) according to the embodiment of the present invention, the sensor (24) is not in direct contact with the ball (7) and thus there is an advantage that the ball (7) is worn out or the sensor (24) is not broken by the contact.

The counter (5) according to the embodiment of the present invention has an advantage of more exactly counting the number of balls (7). In addition, since the counter includes the control portion, not only the number of balls but also time can be counted.

Figure 8:
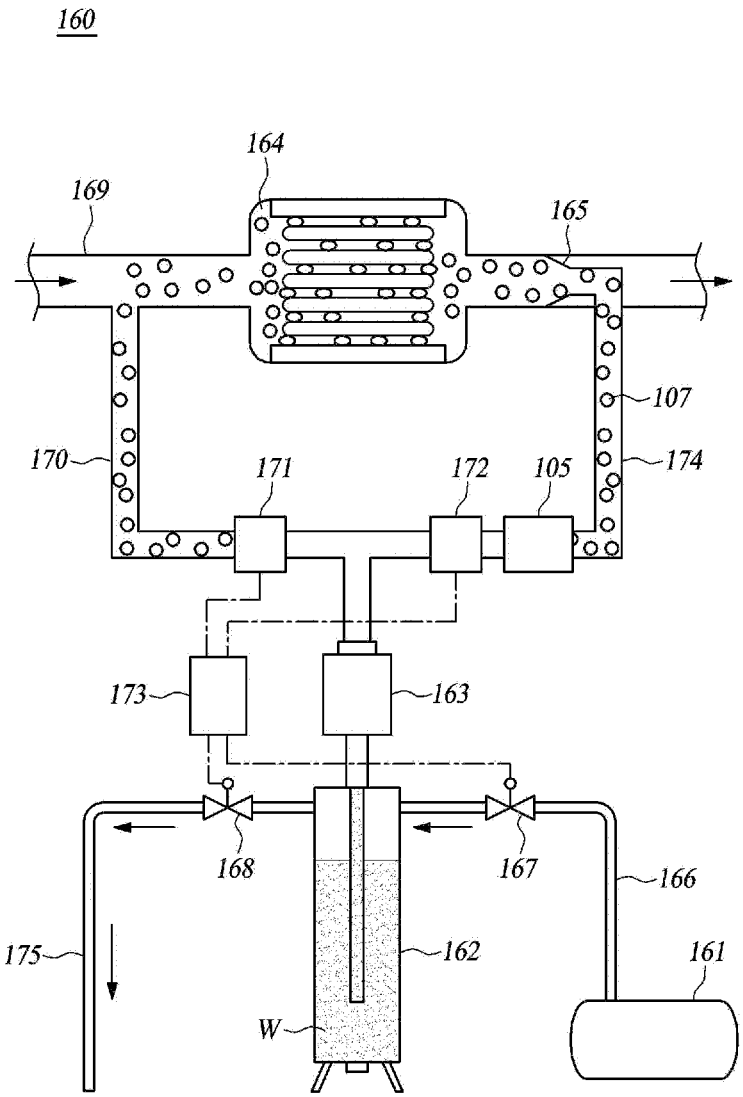
FIG. 8 is a view illustrating an apparatus for recirculating balls according to still another embodiment of the present invention.

FIG. 8 is a view illustrating an apparatus for circulating balls (160) according to still another embodiment of the present invention.

As shown in the drawing, the apparatus for circulating balls (160) includes an air compressor (161) for generating compressed air of high pressure, an injector (162) for accommodating a fluid (w) and discharging the fluid (w) to a heat exchanger of a powder plant by supplying of the high pressured compressed air discharged from the air compressor (161), a ball collector (163) for accommodating a large number of cleaning balls (107) and discharging the cleaning balls (107) to the heat exchanger of the power plant with the high pressure fluid discharged from the injector (162), and a ball strainer (165) for returning the balls (107) discharged from the ball collector (163) and passing through a heat exchanger (164) to the ball collector (163).

A first solenoid valve (167) is arranged in a pipe (166) which connects the air compressor (161) and the injector (162), a first check valve (171) is arranged in a pipe (170) which connects the ball collector (163) and an inlet pipe (169) in a heat exchanger system, and a second check valve (172) is arranged in a pipe (174) which connects the ball strainer (165) and the ball collector (163). In addition, in the injector (162), a drain pipe (175) is arranged so as to discharge the high pressure compressed air in the injector (162) to the outside, and a second solenoid valve (168) is arranged in the middle of the drain pipe (175).

A control portion (173) controls the opening/closing period of the first and second solenoid valves (167, 168) so that the apparatus for circulating balls (160) is operated smoothly.

Hereinafter, the operation of the apparatus for circulating balls (160) will be described. In an initial state in which both the first and second solenoid valves (167, 168) are closed, the large number of cleaning balls (107) are gathered in the ball collector (163), and the injector (162) is filled with the fluid (w), when the air compressor (161) is operated by the control portion (173) and the first solenoid valve (167) is opened, high pressure air flows into the injector (162) from the compressor (161) to pressurize the fluid (w). The applied pressure is transmitted into the ball collector (163) and the large number of cleaning balls (107) in the ball collector (163) are injected into the inlet of the heat exchanger (164) though the first check valve (171) and the pipe (170). When a preset period of time in which the cleaning balls (107) are injected into the heat exchanger (164) from the ball collector (163) has passed, the control portion (173) converts the state of the first solenoid valve (167) into the closed state. The large number of cleaning balls (107) injected into the heat exchanger (164) remove scale fixed on the wall surface while being in tight contact with the wall surface of the pipe of the heat exchanger (164). The fluid passing through the heat exchanger (164) passes through the outlet pipe and then is discharged to the outside though the ball strainer (165), and the cleaning balls (107) pass through the ball strainer (165) and the pipe (174) and are recirculated through the second check valve (172) and the first check valve (171). When the cleaning is completed, the control portion (173) closes the second check valve (172) and the cleaning balls (107) stand by in a stationary state at the inlet of the second check valve (172) through the pipe (174). When the preset period of time in which all the cleaning balls (107) can pass through the heat exchanger (164) has passed, the control portion (173) opens the second solenoid valve (168) to discharge the high pressure air in the injector (162) to the outside through the drain pipe (175). At the same time, the cleaning balls (107) are returned into the ball collector (163) through the second check valve (172) and the injector (162) is refilled with the fluid through the ball collector (163). When the preset period of time in which the ball collector (163) can collect all the cleaning balls (107) has passed, the control portion (173) closes the second solenoid valve (168) and thus the state of the apparatus for circulating balls (160) is returned to the initial state.

In the apparatus for circulating balls (160), the counter (105) may be arranged in the middle of the pipe (174) connecting the outlet of the ball strainer (165) and the inlet of the second check valve (172) depending on embodiments.

While the present invention has been described with reference to some embodiments in the detailed description of the present invention, it will be understood by those skilled in the art that various corrections and changes may be made therein without departing from the scope of the invention.

REFERENCE NUMERALS

1: Apparatus for recycling balls according to embodiment
2: Heat exchanger
3: Circulation path
4: Pump
5: Counter
7: Ball
8: Strainer
11: Cooling water tube
21: First passage pipe
22: Second passage pipe
23: Screen
24: Sensor
40: Conventional counter
50: Improved conventional counter
160: Apparatus for recycling balls according to another embodiment

CROSS-REFERENCE TO RELATED APPLICATION

This application claims a priority under 35 U.S.C §119 (a) on Patent Application No. 10-2012-0104771, filled in Korean on Sep. 20, 2012, and Patent Application No. 10-2012-0104772, filled in Korean on Sep. 20, 2012, the entire contents of which are incorporated herein by reference.

The invention claimed is:

1. An apparatus for circulating balls comprising:
a circulation path in which fluid and balls circulate, the circulation path comprising a cooling water tube of a heat exchanger;
a pump arranged in the circulation path for pumping the balls; and
a counter for counting time and the number of the balls in relation to the circulation of the balls
wherein the counter includes:
a first passage pipe in which the balls and the fluid flow,
a second passage pipe arranged in the first passage pipe,
a screen arranged in the first passage pipe and having an inclined surface for guiding the balls flown into the first passage pipe to the second passage pipe, and
a sensor for counting the number of balls flowing in the second passage pipe.

2. The apparatus for circulating balls according to claim 1,
wherein the counter counts the number of balls passing the counter for a predetermined period of time which is a ball circulation period, and wherein a ball period circulation rate is calculated by dividing the number of balls counted by the number of balls input into the circulation path.

3. The apparatus for circulating balls according to claim 1,
wherein the counter counts the time for a predetermined number of balls making a predetermined number of circulations in the circulation path.

4. The apparatus for circulating balls according to claim 3,
wherein the counter counts the balls until the counted number is the same as the number of balls input into the circulation path and the time for the number of counted balls making the predetermined number of circulations in the circulation path
and wherein the predetermined number of balls is the number of balls actually cycling in the circulation path or smaller than the number of balls input into the circulation path.

5. The apparatus for circulating balls according to claim 1,
wherein the counter counts the time for a predetermined number of balls passing through the counter.

6. The apparatus for circulating balls according to claim 5,
wherein the counter counts the time for the number of balls input into the circulation path passing through the counter and wherein the predetermined number of balls is the number of balls actually cycling in the circulation path or smaller than the number of balls input into the circulation path.

7. An apparatus for circulating balls comprising:

a circulation path in which fluid and balls circulate, the circulation path comprising a cooling water tube of a heat exchanger;

a pump arranged in the circulation path for pumping the balls; and a counter for counting the balls, wherein the counter includes:

a first passage pipe in which the balls and the fluid flow, a second passage pipe arranged in the first passage pipe, a screen arranged in the first passage pipe and having an inclined surface for guiding the balls flown into the first passage pipe to the second passage pipe, and a sensor for counting the number of balls flowing in the second passage pipe.

8. The apparatus for circulating balls according to claim 7, wherein in the first passage pipe and the second passage pipe, the fluid and the balls flow in the same direction.

9. The apparatus for circulating balls according to claim 7, wherein the first passage pipe has connection portions on both sides.

10. The apparatus for circulating balls according to claim 7, wherein the diameter of the second passage pipe is larger than the diameters of the balls.

11. The apparatus for circulating balls according to claim 7, wherein the screen comprises a plurality of spaces having such sizes that the balls are unable to pass through.

12. The apparatus for circulating balls according to claim 7, wherein the sensor has a light emitting portion and a light receiving portion.

* * * * *